US008790569B2

(12) United States Patent
Reali et al.

(10) Patent No.: US 8,790,569 B2
(45) Date of Patent: Jul. 29, 2014

(54) DEVICE FOR ADJUSTING THE LOCKING POINT OF AN ELECTRODE

(75) Inventors: Silvio Reali, Milan (IT); Giancarlo Cavallini, Monza (IT); Gianlucio Piccardi, Dalmine (IT)

(73) Assignees: Tenova S.p.A., Milan (IT); Piccardi S.R.L., Dalmine (IT)

( * ) Notice: Subject to any disclaimer, the term of this patent is extended or adjusted under 35 U.S.C. 154(b) by 623 days.

(21) Appl. No.: 12/935,682

(22) PCT Filed: Mar. 30, 2009

(86) PCT No.: PCT/IB2009/005169

§ 371 (c)(1),
(2), (4) Date: Dec. 13, 2010

(87) PCT Pub. No.: WO2009/122274

PCT Pub. Date: Oct. 8, 2009

(65) Prior Publication Data

US 2011/0089617 A1 Apr. 21, 2011

(30) Foreign Application Priority Data

Apr. 1, 2008 (IT) ..... BG2008A0017

(51) Int. Cl.
*C22B 9/20* (2006.01)
*C21B 15/00* (2006.01)

(52) U.S. Cl.
USPC ..... 266/200; 266/44; 373/100; 373/94

(58) Field of Classification Search
USPC ..... 266/44, 200; 373/100, 69, 51–55, 373/94–96
See application file for complete search history.

(56) References Cited

U.S. PATENT DOCUMENTS

| | | | | |
|---|---|---|---|---|
| 2,297,484 | A * | 9/1942 | Lehrer et al. | 373/100 |
| 2,538,603 | A * | 1/1951 | Thys | 373/99 |
| 4,543,656 | A | 9/1985 | Evensen | |
| 4,670,884 | A * | 6/1987 | Letizia et al. | 373/101 |
| 7,075,966 | B2 * | 7/2006 | McCaffrey et al. | 373/100 |

FOREIGN PATENT DOCUMENTS

| | | |
|---|---|---|
| DE | 1 254 296 | 11/1967 |
| DE | 33 42 900 | 6/1984 |
| JP | 58-184286 | 10/1983 |

OTHER PUBLICATIONS

International Search Report issued Aug. 19, 2009 in PCT/IB09/005169 filed Mar. 30, 2009.
Notification of Reason for Rejection issued Oct. 7, 2013 in Japanese Patent Application No. 2011-502450 w/English translation.

* cited by examiner

*Primary Examiner* — Scott Kastler
*Assistant Examiner* — Michael Aboagye
(74) *Attorney, Agent, or Firm* — Oblon, Spivak, McClelland, Maier & Neustadt, L.L.P.

(57) ABSTRACT

A device (10) for adjusting the locking point of the electrode of a smelting furnace includes a vice (120) for supporting said electrode and supplying it with power. A structure (13) is coupled with the vice (120), supports the electrode and moves the electrode vertically.

16 Claims, 10 Drawing Sheets

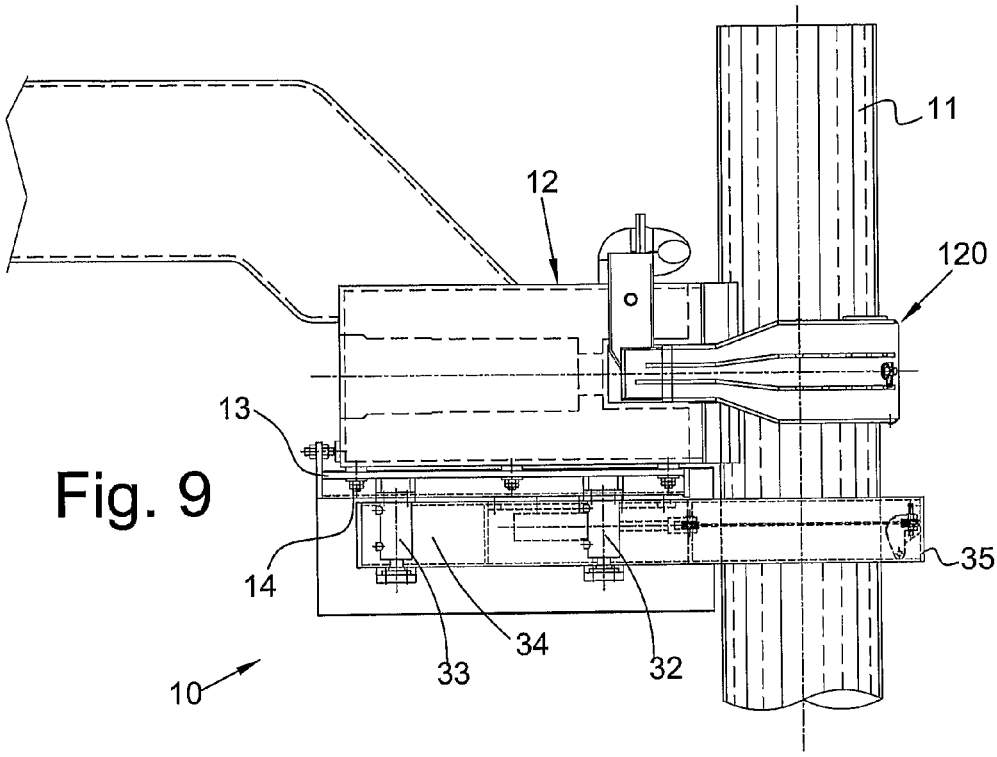
Fig. 9
Fig. 11
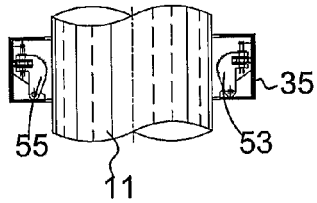
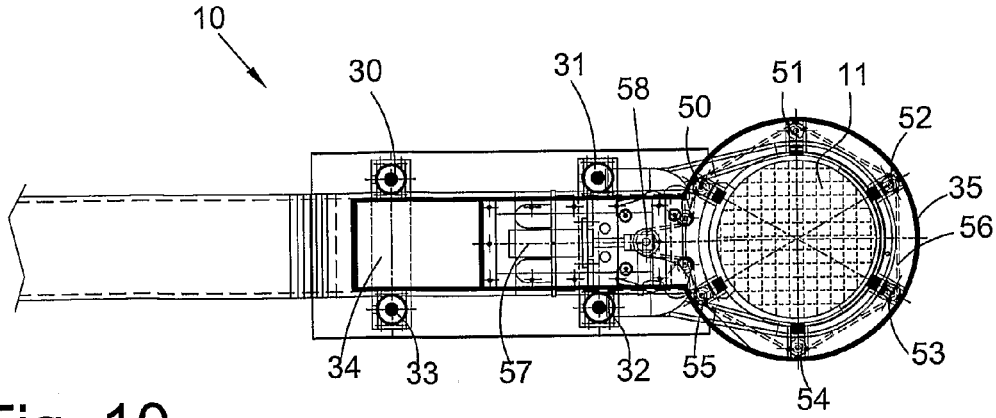
Fig. 10

DEVICE FOR ADJUSTING THE LOCKING POINT OF AN ELECTRODE

BACKGROUND OF THE INVENTION

1. Field of the Invention

The present invention refers to a device for adjusting the locking point of an electrode through an electrode-holding vice of an electric arc smelting furnace.

2. Description of the Related Art

Smelting furnaces, generally used in the steel sector, make use of the heat released by electric arcs created through graphite electrodes in order to work.

These electrodes, which are of substantial size, possibly even having a diameter of 800 mm and a length of over 10 m, are supported by vices that are the end part of long steel and copper arms, through which the current necessary for creating the aforementioned electric arcs passes. Such arms stay outside the furnace. Only the part of electrode situated below the vice enters into the furnace.

During operation the electrodes wear down in the bottom part where the arc sparks, and therefore they become gradually shorter. The arc must however always stay in the bottom area of the furnace, in other words where the steel to be poured is located, for which reason the arms go down as low as the cover of the furnace will allow, after which it is necessary to intervene to adjust the relative position between arm and electrode. This normally occurs, after stopping the furnace from operating, through the bridge crane that, in different ways, hooks and holds the electrode while the vice is opened, moved vertically and closed again higher up.

This system, which is currently used in almost all steelworks, has some substantial drawbacks.

In order to carry out the operation it is necessary to stop the furnace for the entire duration of the operation itself, in other words for 2-5 minutes, which, for a modern steelworks, represents a very long time and therefore a very high cost.

The overwhelming majority of steelworks uses the hook of the crane directly to take hold of the electrode. Such a hook, in order to be able to hook onto and unhook from the ring of the nipple located on the top part of the electrode, must be without the obligatory safety device.

The crane in a steelworks is an extremely valuable piece of machinery, which should always be available for emergencies.

BRIEF SUMMARY OF THE INVENTION

The purpose of the present invention is to provide a device that can carry out the adjustment of the positioning of the electrode, with respect to the vice of the furnace, automatically, without the use of the crane and preferably exploiting the idle times that exist when the furnace is open to be able to tap the molten steel.

Another purpose is to provide a device, which can also operate at the high temperatures connected with melting of steel.

In accordance with the present invention, such purposes and others are accomplished by a device for adjusting the locking point of the electrode of a smelting furnace comprising: a vice for supporting and supplying said electrode with power, characterised in that it comprises a structure coupled with said vice comprising support means for said electrode and means for moving said electrode vertically.

Such purposes are also accomplished by a method for adjusting the locking point of an electrode of a smelting furnace through an electrode-holding vice, comprising the steps of coupling support means of said electrode with said vice and means for moving said electrode vertically.

Further characteristics of the invention are described in the dependent claims.

BRIEF DESCRIPTION OF THE DRAWINGS

The characteristics and advantages of the present invention shall become clear from the following detailed description of some practical embodiments thereof, illustrated as non-limiting examples in the attached drawings, in which:

FIGS. 9, 10, 11, 12, 13 and 14 show a device for adjusting the locking point of the electrode in accordance with a third embodiment, the first three figures with the device open and with the gripping members in their highest point, and the other three with the device closed and with the gripping members in their lowest point;

DETAILED DESCRIPTION OF THE PREFERRED EMBODIMENTS

Figure 1:
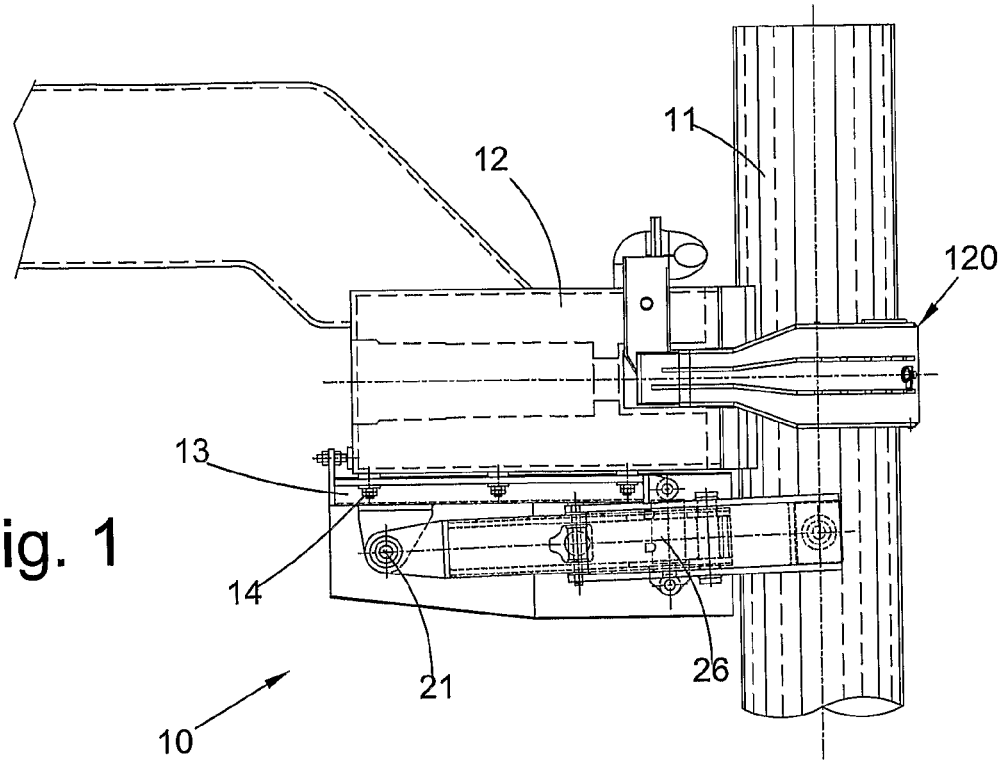
FIGS. 1, 2, 3 and 4 show a device for adjusting the locking point of the electrode in accordance with a first embodiment, the first two figures with the device open and with the gripping members in their highest point, and the other two with the device closed and with the gripping members in their lowest point.

With reference to the attached figures, a device 10 for adjusting the locking point of the electrode 11 through an arm 12 with relative electrode-holding tongs 120, or electrode-holding vice, comprises a metallic structure 13 intended to be fixed through screws 14, suitably electrically insulated, to the electrode-holding arm 12, in the bottom part or even in the top part. Such a structure 13 is intended to be adjusted along the length of the arm, to define the correct position with respect to the electrode 11.

The structure 13 comprises support means and means for moving the electrode 11 vertically.

As indicated above, the structure 13 can be fixed to the arm 12 in the bottom part or in the top part thereof.

Figure 2:
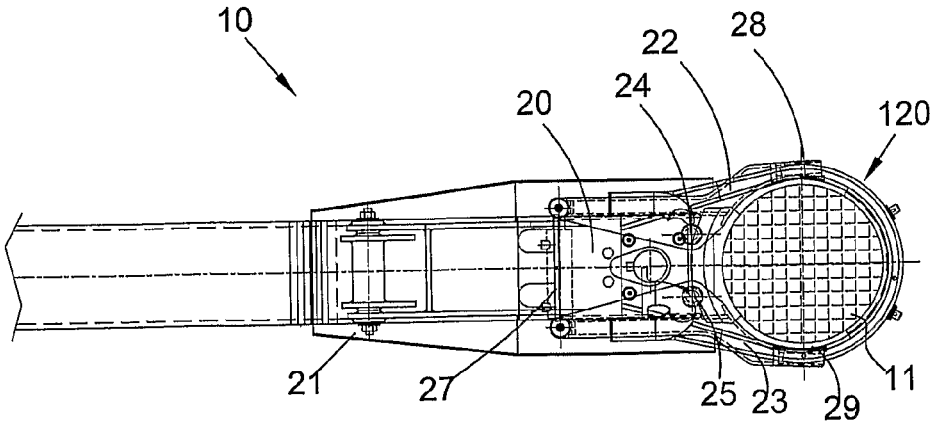
Figure 3:
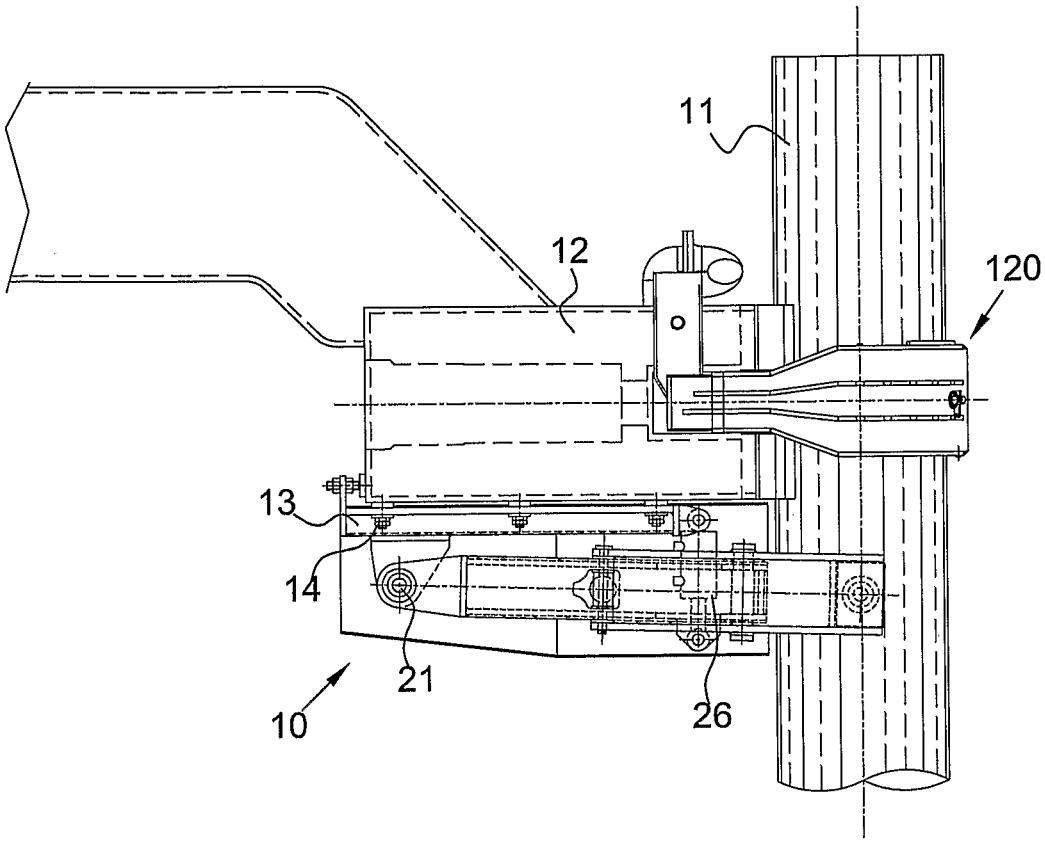
Figure 4:
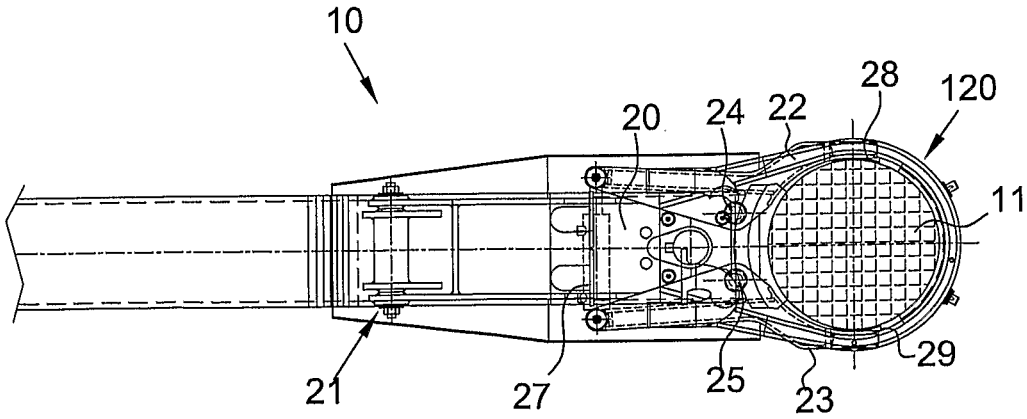
Figure 5:
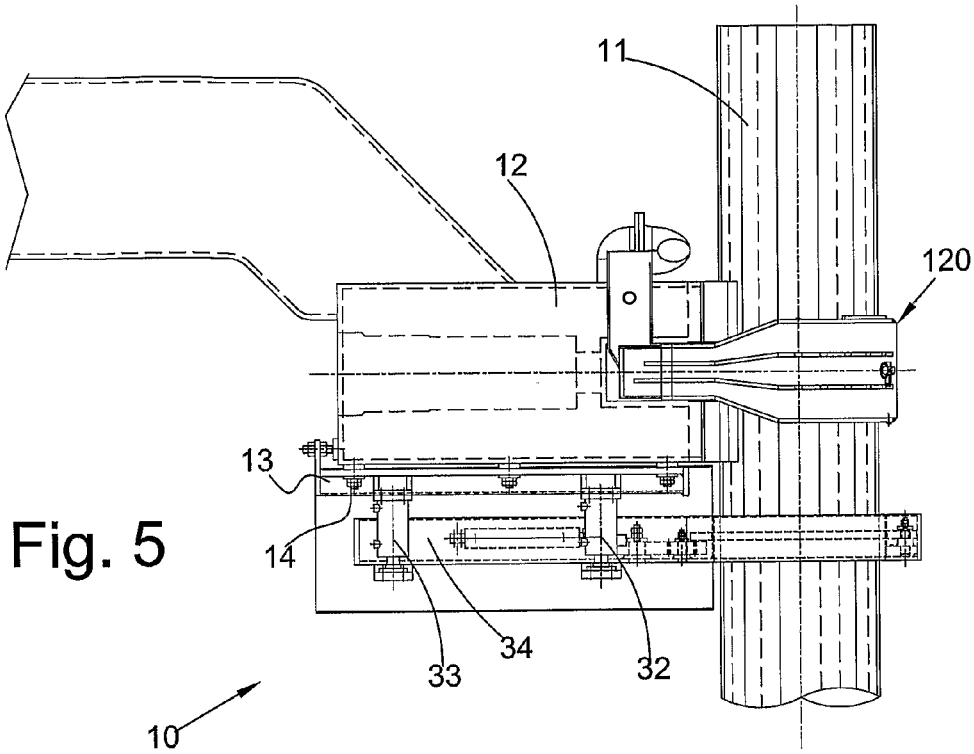
FIGS. 5, 6, 7 and 8 show a device for adjusting the locking point of the electrode in accordance with a second embodiment, the first two figures with the device open and with the gripping members in their highest point, and the other two with the device closed and with the gripping members in their lowest point.
Figure 6:
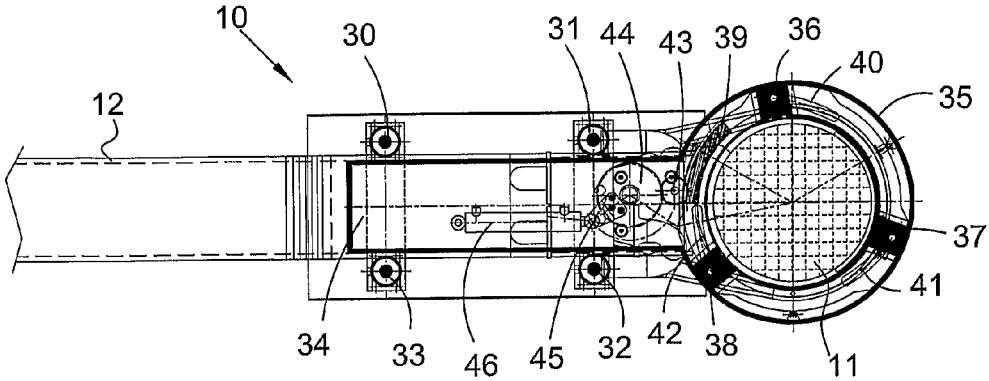
Figure 7:
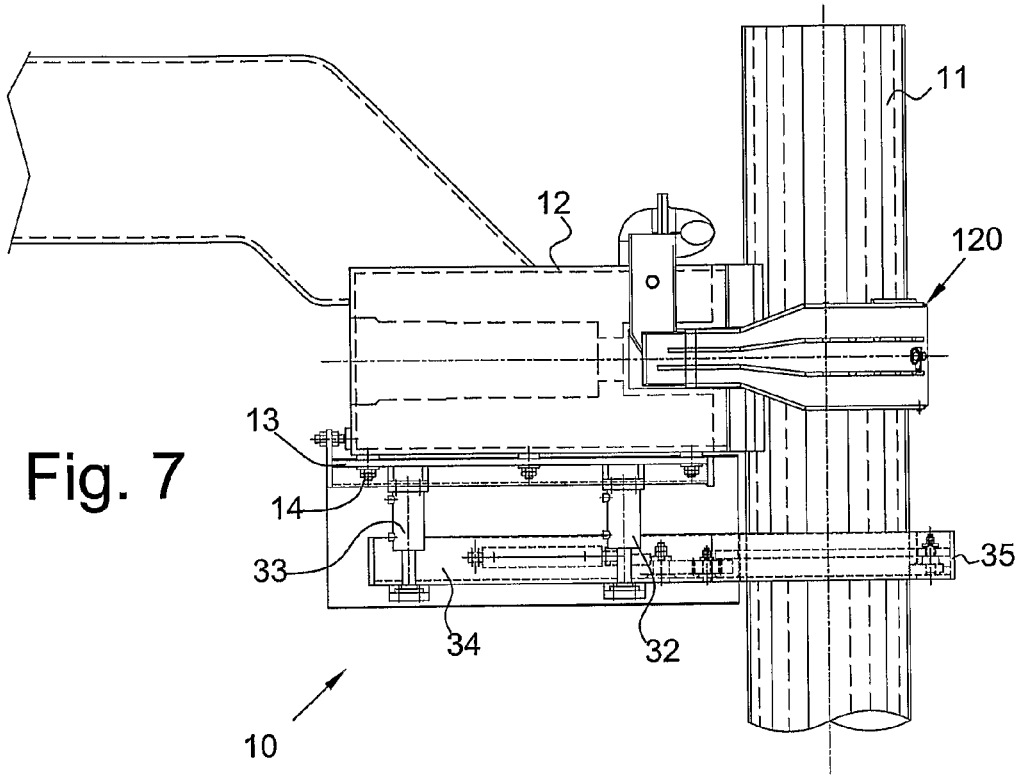
Figure 8:
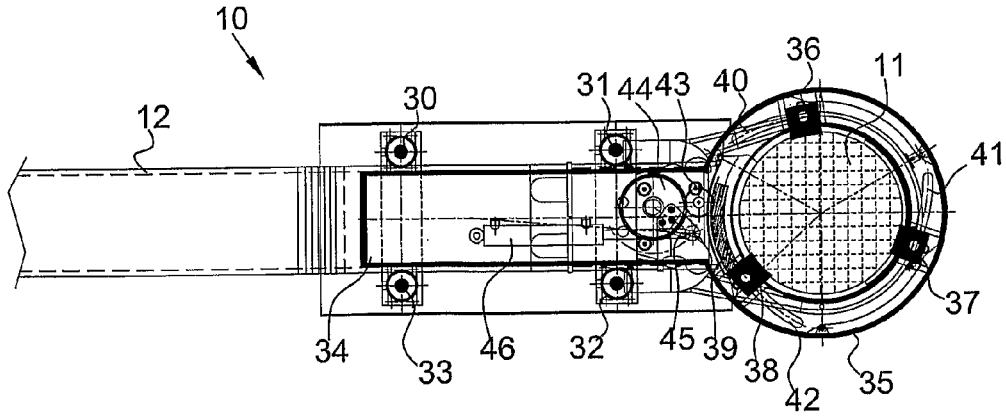
Figure 12:
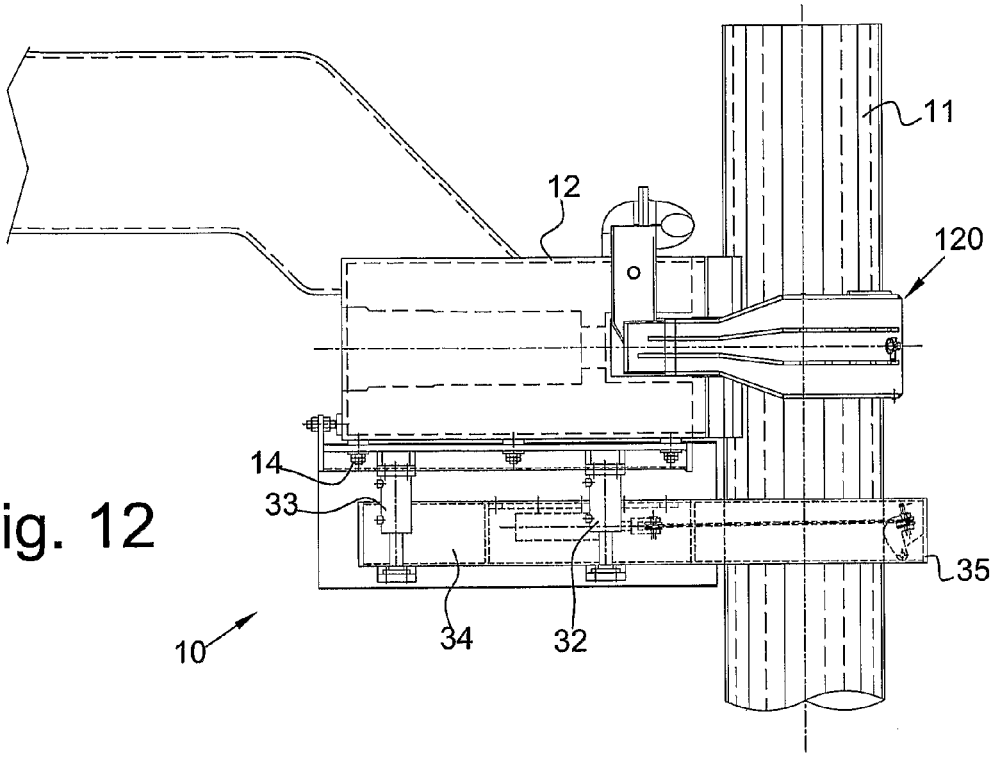
Figure 14:
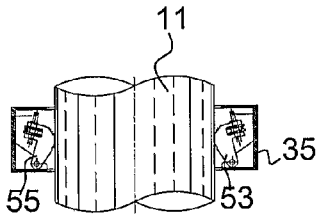
Figure 13:
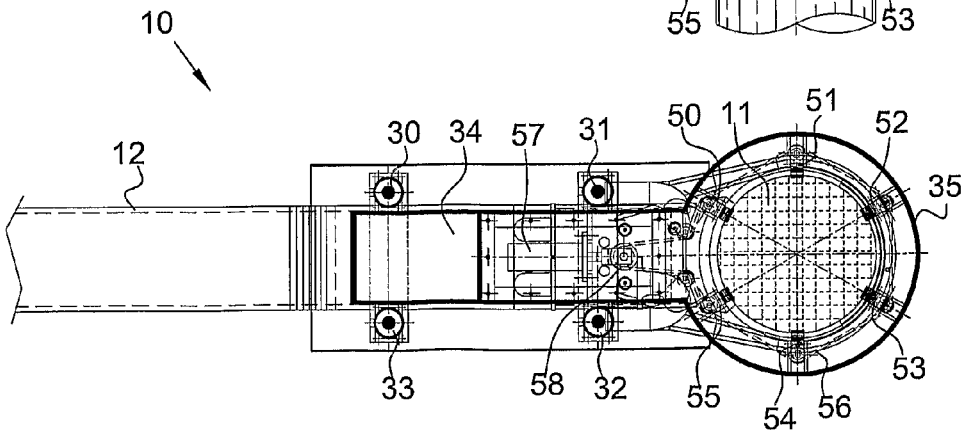
Figure 15:
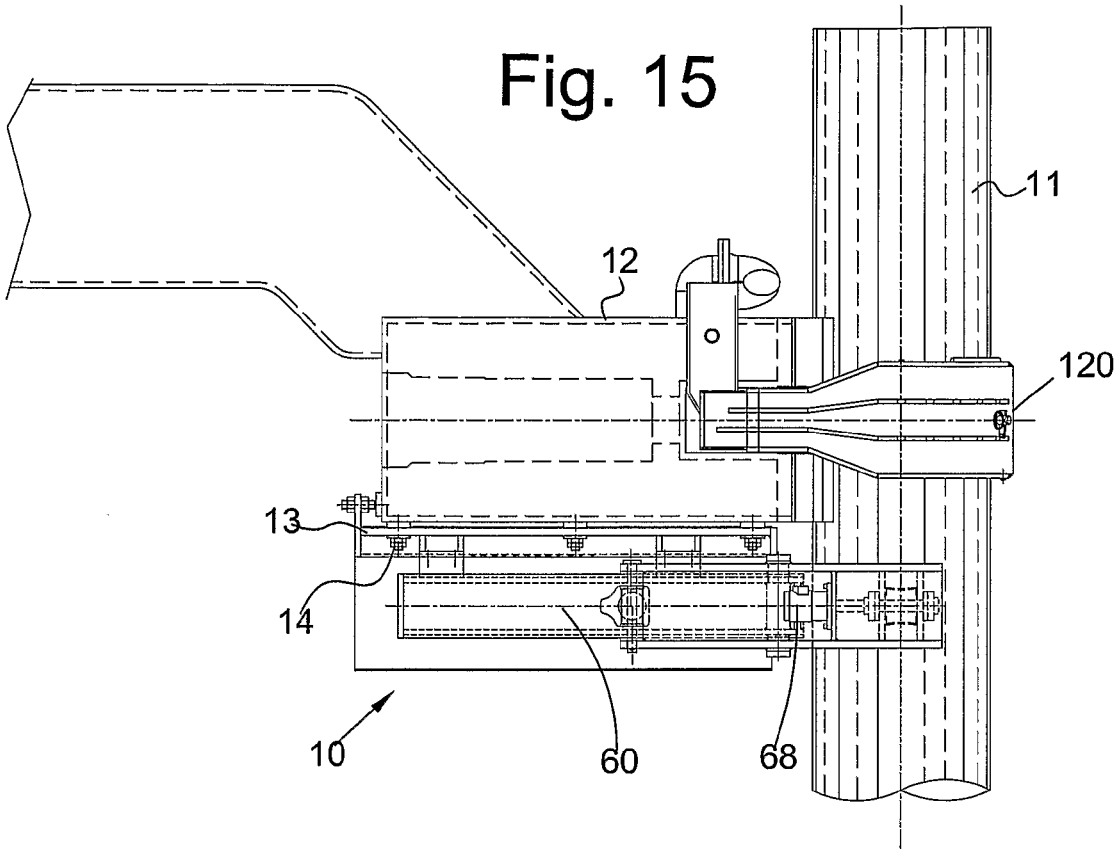
FIGS. 15, 16, 17 and 18 show a device for adjusting the locking point of the electrode in accordance with a fourth embodiment, the first two figures with the device closed, and the other two with the device open.
Figure 16:
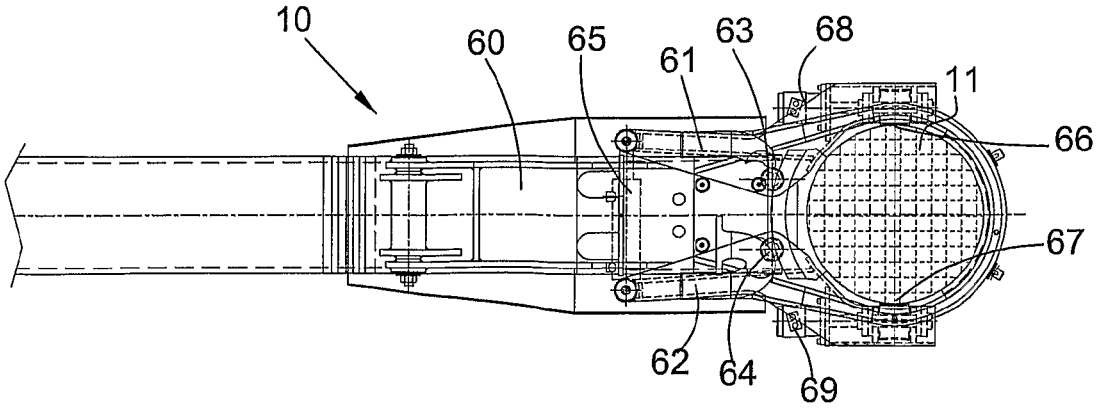
Figure 17:
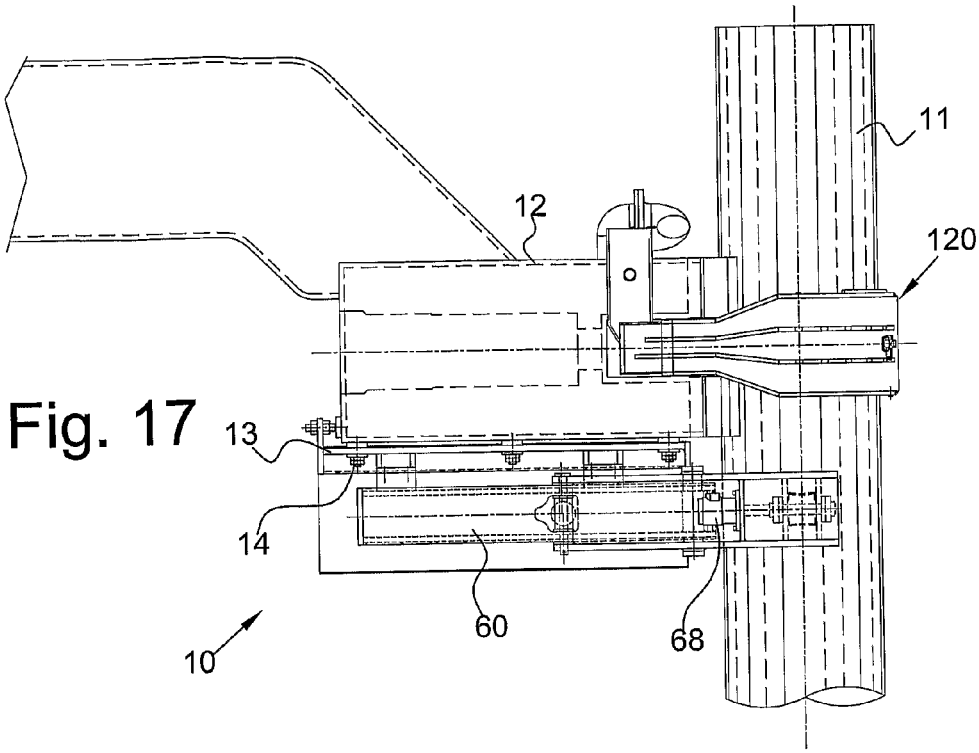
Figure 18:
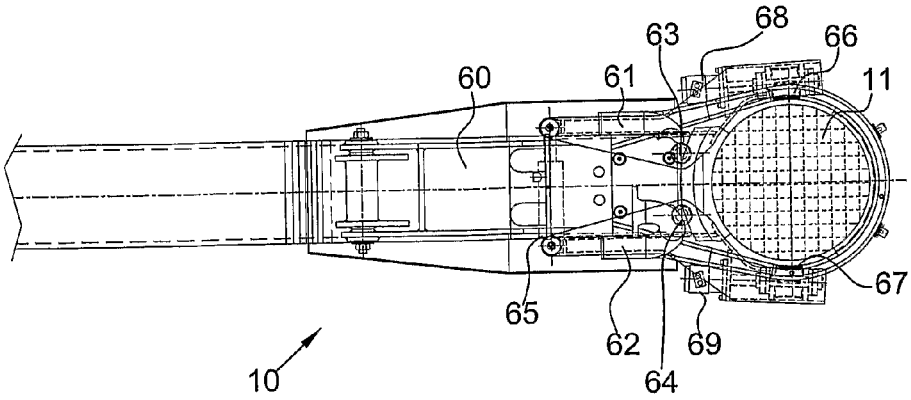

In the first four embodiments of the device 10 illustrated in FIGS. 1-18, the structure 13 is fixed to the bottom part of the arm 12. In this case, in operating configuration, the support means and the means for moving the electrode 11 vertically are at a lower height than that of the electrode-holding tongs 120, in other words they are below them.

Figure 19:
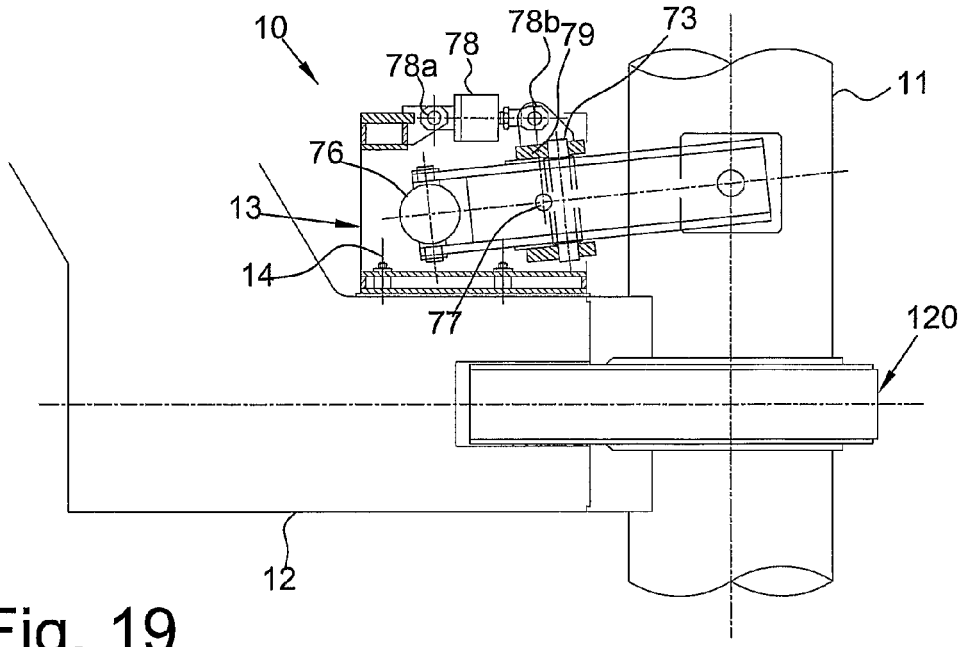
FIGS. 19, 20, 21 and 22 show a device for adjusting the locking point of the electrode in a fifth embodiment, the first two figures with the device closed and the gripping members in their highest point and the other two with the device open and the gripping members in their lowest point.
Figure 20:
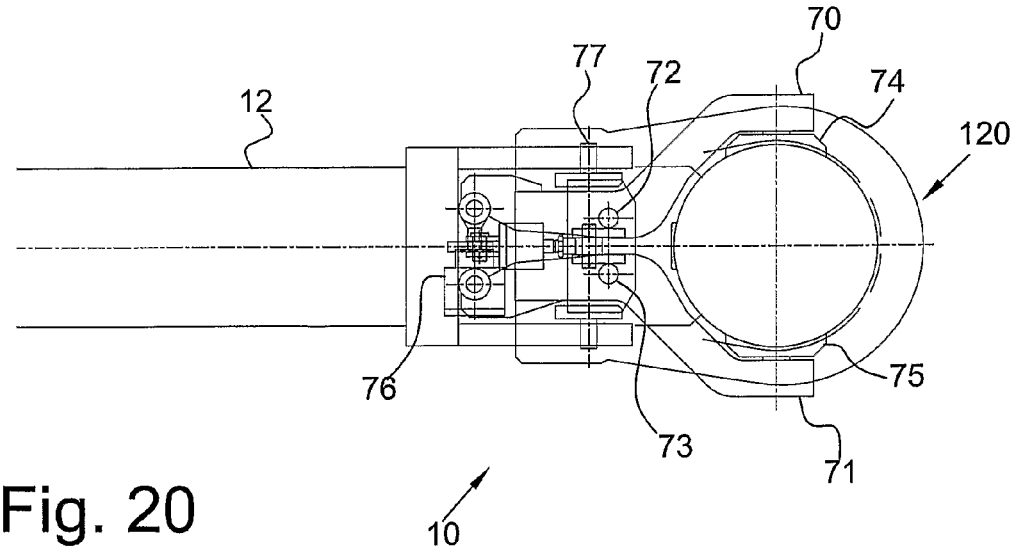
Figure 21:
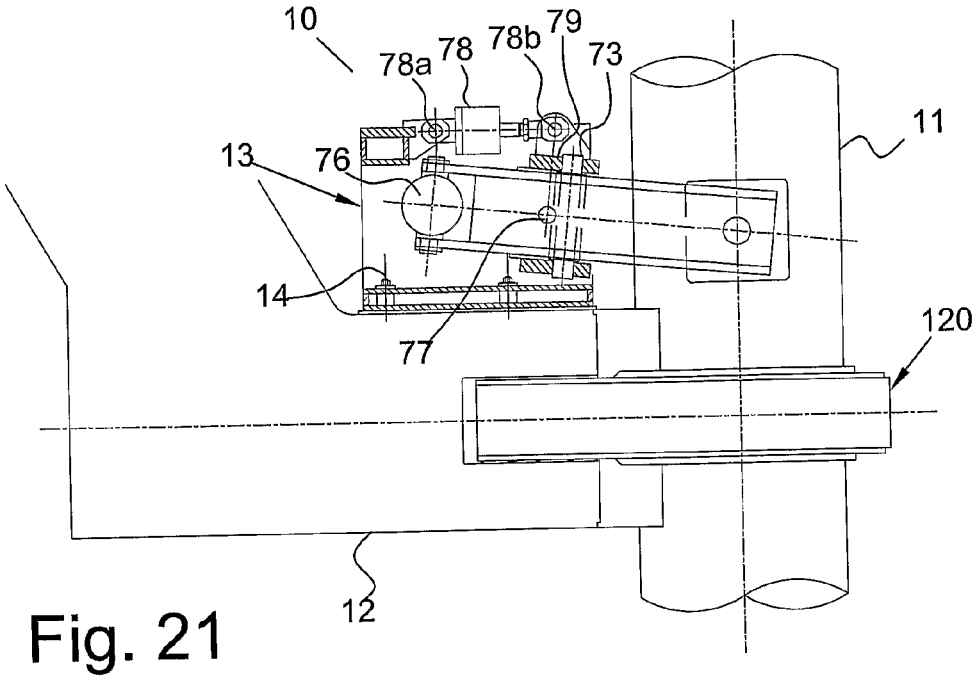
Figure 22:
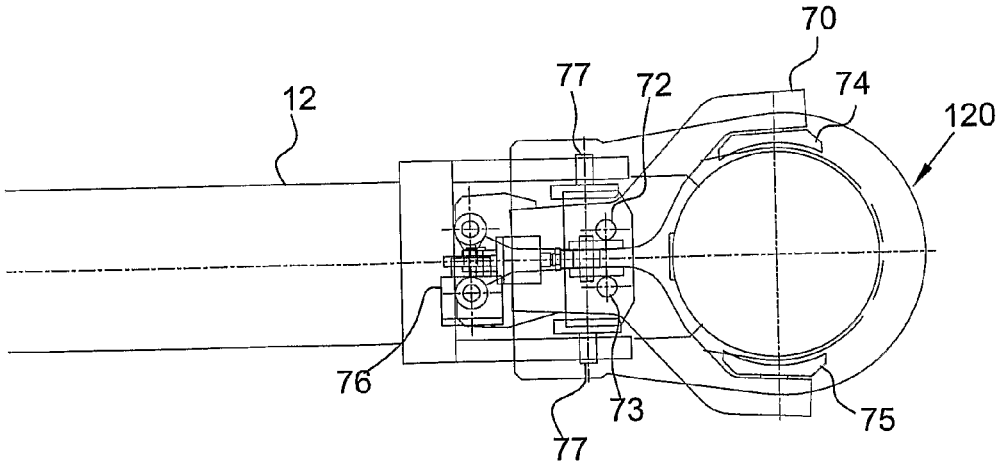

In the fifth embodiment of the device 10, illustrated in FIGS. 19-22, the structure 13 is fixed to the top part of the arm 12. In this case, in operating configuration, the support means and the means for moving the electrode 11 vertically are at a greater height than that of the electrode-holding tongs 120, in other words they are above them. This arrangement, as shall become clearer hereafter, offers advantages both in terms of structure and in terms of operation.

In accordance with a first embodiment of the present invention, a horizontal plate 20 is connected to the structure 13. The plate 20 is hinged, on one side, to a suspension pin 21, having its axis arranged along an axis alongside the electrode 11, and perpendicular to it.

On the other side of the plate 20 two tongs 22 and 23 are coupled, through the respective pivots 24 and 25.

A first hydraulic cylinder 26 is connected between the structure 13 and the plate 20, on the opposite side to where the plate 20 is hinged. The cylinder 26 provides a vertical movement of an extremity of the plate 20 and thus a vertical movement of the tongs 22 and 23.

A second hydraulic cylinder 27 is connected between the two tongs 22 and 23 on the opposite side to that of the gripping members 28 and 29. The cylinder 27 provides an opening and closing movement of the tongs 22 and 23 and thus of the gripping members 28 and 29.

The adjustment of the position of the electrode 11 with respect to the arm 12 is carried out automatically or manually with the following sequence.

The cylinder 26 closes and positions the gripping members 28 and 29 in their highest point.

The cylinder 27 extends and closes the gripping members 28 and 29 of the two tongs 22 and 23 on the electrode 11.

The electrode-holding tongs 120 of the arm 12 open.

The cylinder 26 extends and moves the electrode 11 downwards.

The electrode-holding tongs 120 of the arm 12 close.

The cylinder 27 closes and opens the gripping members 28 and 29.

What has been described above relates to the downward movement of the electrode 11, for a possible raising of the electrode 11 the sequence is reversed but is analogous.

Since the vertical movement is relatively small (for example 100 mm), it is foreseen for it to be possible to programme many successive cycles also automatically.

As an alternative to the suspension pin 21 and the hydraulic cylinder 26 it is possible to use four hydraulic cylinders 30, 31, 32, 33, as better described in the following embodiments. The two structures should be considered equivalent for the vertical movement of the electrode.

In accordance with a second embodiment of the present invention, the structure 13 has four hydraulic cylinders 30, 31, 32, 33 connected to it, which are in turn connected to a bar 34 ending with a ring 35 that encircles the electrode 11.

The four hydraulic cylinders 30, 31, 32, 33 allow the vertical movement of the bar 34.

Three jaws 36, 37, 38 are mounted on the ring 35 that moves only radially, by means of special guides, controlled by a circular crown 39 provided with three oblique grooves 40, 41 and 42.

On the bar 34 there is a first gear 43 that engages on the circular crown 39 and on a second gear 44. The second gear 44 has a lever 45 positioned on it that is controlled by a hydraulic piston 46.

The hydraulic piston 46 actuates the gears 43 and 44, making the circular crown 39 rotate. When the circular crown 39 rotates, the grooves 40, 41 and 42, engaged on three rollers mounted on the jaws 36, 37, 38, force them towards the electrode locking it.

The adjustment of the position of the electrode 11 with respect to the arm 12 is carried out substantially like for the previous case.

The cylinders 30, 31, 32, 33 close and position the ring 35 in its highest point.

The cylinder 46 extends and closes the jaws 36, 37, 38 on the electrode 11.

The electrode-holding tongs 120 of the arm 12 open.

The cylinders 30, 31, 32, 33 extend and the electrode 11 moves downwards.

The electrode-holding tongs 120 of the arm 12 close.

The cylinder 46 contracts and the jaws 36, 37, 38 open.

In accordance with a third embodiment of the present invention, the structure 13 has four hydraulic cylinders 30, 31, 32, 33 connected to it, which are in turn connected to a bar 34 ending with a ring 35 that encircles the electrode 11.

The four hydraulic cylinders 30, 31, 32, 33 allow the vertical movement of the bar 34.

The ring 35 has six jaws 50, 51, 52, 53, 54 and 55 mounted on it that move only radially, by means of special guides, controlled by a metallic cable 56 in a closed loop that closes on the jaws themselves through the effect of the movement of a hydraulic cylinder 57. The hydraulic cylinder 57 actuates a pulley 58, which can move along the longitudinal axis of the bar 34, on which the metallic cable 56 is made to run.

In order to lock the electrode 11, the hydraulic cylinder 57 is closed, which, bringing the pulley 58 closer to it, places the cable 56 under tension, which makes the six jaws 50, 51, 52, 53, 54 and 55 run in the special guides that come into contact with the electrode 11.

In order to release the electrode 11 and move the ring 35, the hydraulic cylinder 57 is opened, and some springs (not shown) take the pulley 58 back into its rest position.

In accordance with a fourth embodiment of the present invention, the structure 13 has a structure 60 connected to it on which two tongs 61 and 62 are coupled, through the respective pivots 63 and 64. A hydraulic cylinder 65 is connected between the two tongs 61 and 62 on the opposite side to that of the gripping members 66 and 67.

The gripping members 66 and 67 consist of two gears, controlled by two hydraulic motors 68 and 69, which, rotating in synchrony with each other, move the electrode 11 with continuity downwards or upwards.

The hydraulic cylinder 65 opens and closes the two tongs 61 and 62 and the two hydraulic motors 68 and 69 raise and lower the electrode 11.

In accordance with a fifth embodiment of the device 10 object of the present invention, the structure 13 is fixed to the arm 12 in the top part thereof so that, in operating configuration, the support means and the means for moving the electrode 11 vertically are at a greater height than that of the electrode-holding tongs 120, in other words they are above them.

The support means and the means for moving the electrode 11 vertically comprise a pair of tongs 70 and 71 each of which is pivoted around a respective pin 72 and 73 and has an end for gripping the electrode 11 provided with respective gripping members 74 and 75. The ends of the tongs 70 and 71 opposite the gripping end are connected together by a first cylinder 76 that controls its closing and opening, respectively, to hold and release the electrode 11.

The two tongs 70 and 71 are also hinged to the structure 13 around respective pins with horizontal axis 77 so as to be able to oscillate on the vertical plane.

The oscillation of the two tongs 70 and 71 around the horizontal axis 77 is controlled by a second cylinder 78, which has one end **78*a* articulated to the structure 13 and the opposite end 78*b* articulated to a bracket 79 fixedly connected to the two tongs 70 and 71. The extension and the retraction of the second cylinder 78 control the oscillation of the tongs 70 and 71 around the horizontal axis 77 in the two opposite directions, so as to move the gripping ends of the tongs 70 and 71** vertically downwards or upwards.

The adjustment of the position of the electrode 11 with respect to the arm 12 takes place in the following way:

When the electrode-holding tongs 120 are still clamped around the electrode 11, the second cylinder 78 is actuated so as to make the tongs 70 and 71 rotate around the horizontal axis 77 so as to lift their gripping ends, kept in open configuration, vertically upwards.

When the gripping ends of the tongs 70 and 71 have been raised to the desired height, the first cylinder 76 is extended so that the two tongs 70 and 71, oscillating around the respective pins 72 and 73, are closed to clamp their gripping ends around the electrode 11.

The electrode-holding tongs 120 are released and the electrode 11 is supported by the tongs 70 and 71.

The second cylinder 78 is then actuated so as to make the tongs 70 and 71 rotate around the horizontal axis 77 so as to lower their gripping ends, kept in closed configuration around the electrode 11, vertically downwards; in this way the electrode 11 is moved vertically downwards by a programmed height.

At this point, the electrode-holding tongs 120 are clamped around the electrode 11 and the first cylinder 76 is retracted so that the two tongs 70 and 71, oscillating around the respective pins 72 and 73, are opened moving their gripping ends away from the electrode 11.

The electrode-holding tongs 120 support the electrode 11 and feed it with power and the device 10 is ready to repeat the sequence of operations described above.

Should it be necessary to raise the electrode 11, for example to add a portion of graphite, the operations indicated above are carried out in reverse.

The arrangement of the tongs 70 and 71 and, more generally, of the support means and of the means for moving vertically to a greater height, in operating conditions, than that of the electrode-holding tongs 120, has some advantages compared to the opposite arrangement.

Indeed, with such an arrangement the tongs 70 and 71 and, more generally, the support means and the means for moving the electrode 11 vertically, are connected to a portion of the electrode itself that, with the furnace in working configuration, does not have current passing through it. Such a portion, therefore, constitutes an open electric circuit and is at the same electrical potential with the power supply provided by the electrode-holding tongs 120.

In this case, therefore, it is not strictly necessary to electrically insulate the device 10 from the arm 12, since it is not possible for so-called "electric loop" effects to be created that, on the other hand, are created with the opposite arrangement, in other words with the arrangement of the means for supporting the electrode 11 and for moving it vertically beneath the electrode-holding tongs 120.

The arrangement of the tongs 70 and 71 and, more generally, of the means for supporting the electrode 11 and for moving it vertically, at a greater height than that of the electrode-holding tongs 120, thus results in the bulk and weight of the entire device being kept low.

In any case, the device object of the invention allows the electrode to be moved vertically in shorter periods of time compared to what is required by the prior art with consequent gains in terms of productivity. Moreover, the device object of the present invention allows the height of the electrode to be modified without the need to open the furnace, with a consequent energy saving.

In practice, the materials used, as well as the sizes, can be whatever according to the requirements and the state of the art.

The device thus conceived can undergo numerous modifications and variants, all of which are covered by the scope of protection of the inventive concept; moreover, all of the details can be replaced with technically equivalent elements.

The invention claimed is:

1. A device for adjusting a locking point of an electrode of a smelting furnace, comprising:

a vice configured to releasably support the electrode and connected to a source of electricity for supplying the electrode with power;

a supporting structure mounted to the vice, a gripping device positioned to selectively grip and support the electrode at a position on the length of the electrode different from a position of support by the vice; and gears driven by hydraulic motors and positioned on the gripping device to engage the electrode, to adjust the position of the electrode when the gripping device selectively grips the electrode, at a time when the vise is open and released from the electrode.

2. A device according to claim 1, wherein the gears are supported by two pivoted tongs pivotally mounted on a support plate further comprising a hydraulic cylinder arranged between the two tongs to pivot the tongs.

3. A device for adjusting a locking point of an electrode of a smelting furnace, comprising:

a vice configured to releasably support the electrode and connected to a source of electricity for supplying the electrode with power;

a supporting structure mounted to the vice;

a gripping device positioned to selectively grip and support the electrode at a position on the length of the electrode different from a position of support by the vice;

means for mounting the gripping device to the supporting structure;

means for controllably moving the gripping device to selectively grip and release the electrode; and means for selectively moving the gripping device, which is gripping the electrode, toward and away from the vice along a length of the electrode at a time when the vise is open and released from the electrode.

4. A device according to claim 3, wherein the gripping device comprises two tongs.

5. A device according to claim 4, wherein the means for controllably moving the gripping device to selectively grip and release the electrode comprises the two tongs being pivotally mounted on a support plate and a hydraulic cylinder arranged between the two tongs.

6. A device according to claim 3, wherein the gripping device comprises jaws that mounted to move radially with respect to the electrode.

7. A device according to claim 6, wherein the gripping device further comprises a ring that runs around the electrode and where the jaws are located.

8. A device according to claim 6, wherein the jaws are actuated by a circular crown including oblique grooves where pins connected to the jaws can slide.

9. A device according to claim 8, wherein the circular crown is actuated by a hydraulic cylinder that actuates a lever that makes at least one gear rotate.

10. A device according to claim 6, wherein the jaws are actuated by a metallic cable in a closed loop.

11. A device according to claim 10, wherein the metallic cable is actuated by a hydraulic cylinder that makes a pulley move, on which the metallic cable runs.

12. A device according to claim 3, wherein the means for mounting the gripping device to the supporting structure comprises a plate pivotally hinged to the support structure by a suspension pin having an axis arranged alongside the electrode and perpendicular to the length of the electrode, and the means for selectively moving the gripping device toward and away from the vice along the length of the electrode comprises a hydraulic cylinder connected between the plate and the supporting structure.

13. A device according to claim 3, wherein the means for selectively moving the gripping device toward and away from the vice along the length of the electrode comprises four hydraulic cylinders arranged vertically between the supporting structure and the means for mounting the gripping device to the supporting structure.

14. A device according to claim 3, wherein the supporting structure is coupled above the vice.

15. A device according to claim 3, wherein the supporting structure is coupled below the vice.

16. A device according to claim 3, wherein the supporting structure is mounted to the vice so as to be electrically insulated from electric current supplied to the electrode by the vice.

* * * * *